US011008082B1

(12) United States Patent
Shaver

(10) Patent No.: US 11,008,082 B1
(45) Date of Patent: May 18, 2021

(54) PADDLE FOR PROPULSION OF WATERCRAFT

(71) Applicant: Joseph Shaver, Hastings, MI (US)

(72) Inventor: Joseph Shaver, Hastings, MI (US)

( * ) Notice: Subject to any disclaimer, the term of this patent is extended or adjusted under 35 U.S.C. 154(b) by 0 days.

(21) Appl. No.: 17/108,067

(22) Filed: Dec. 1, 2020

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS 4,673,361 A * 6/1987 Harvey ..... B63H 16/04 416/72
4,841,755 A * 6/1989 Weinerman ..... E05B 9/08 292/227
5,820,424 A 10/1998 Steinhour et al.
6,514,109 B1 2/2003 Carlow
7,708,610 B1 * 5/2010 Horan ..... B63H 16/04 440/102
8,057,271 B2 11/2011 Hevesi et al.
8,684,778 B1 * 4/2014 Bergman ..... B63H 16/04 440/101
10,308,337 B1 * 6/2019 Liveoak ..... B63H 16/04
2005/0153606 A1 * 7/2005 Lane ..... B63H 16/04 440/101
2010/0124859 A1 * 5/2010 Bucknell ..... B63H 16/04 440/101
2014/0017963 A1 * 1/2014 Lazarovits ..... B63B 32/50 441/74
2016/0313084 A1 * 10/2016 Hunter ..... F41B 5/10
2019/0308708 A1 * 10/2019 Marjan ..... B63B 32/56

* cited by examiner

*Primary Examiner* — S. Joseph Morano
*Assistant Examiner* — Jovon E Hayes
(74) *Attorney, Agent, or Firm* — Ballard Spahr LLP

(57) ABSTRACT

A paddle for watercraft has a shaft to which blades are attached at opposite ends. The blades may be mounted directly to the shaft or via drop cranks. The shaft is suspended on handles oriented transversely to the shaft's longitudinal axis. The handles are capable of pivoting motion relative to the shaft as well as rotational motion about their respective longitudinal axes.

30 Claims, 6 Drawing Sheets

PADDLE FOR PROPULSION OF WATERCRAFT

FIELD OF THE INVENTION

This invention relates to paddles for propulsion of watercraft such as kayaks, canoes and the like.

BACKGROUND

It is estimated that the "hunter's boat" or kayak, as it is more commonly known, has been in use for over 4,000 years. Today it is popular as a sport watercraft, used for exercise, fishing and recreation. Modern kayaks have evolved significantly in hull design as well as through the use of synthetic materials, but their propulsion still relies on the two bladed paddle. Traditional paddles, while effective, tend not to place much emphasis on ergonomic design or efficiency, i.e., converting the most muscle power of the user into propulsive force in a way which accommodates the natural limitations on human muscles, tendons and joints. There is clearly an opportunity to improve the propulsive efficiency of two bladed paddles while also favorably increasing their ergonomic features.

SUMMARY

The invention concerns a paddle for watercraft propulsion. In an example embodiment the paddle comprises a shaft having first and second ends oppositely disposed and a longitudinal axis extending therebetween. A first blade is mounted on the first end of the shaft. The first blade defines a first blade axis extending lengthwise along the first blade. A second blade is mounted on the second end of the shaft. The second blade defines a second blade axis extending lengthwise along the second blade. A first handle is mounted on the shaft between the first and second ends thereof. The first handle projects transversely to the longitudinal axis of the shaft. A second handle is mounted on the shaft between the first handle and the second end of the shaft. The second handle projects transversely to the longitudinal axis of the shaft.

In an example embodiment the first and second handles are rotatably attached to the shaft for rotational motion relative to the longitudinal axis of the shaft. In particular by way of example, the first and second handles each comprise a respective grip portion having a terminal end portion extending therefrom. The paddle may further comprise a first ball joint positioned between the terminal end portion of the first handle and the shaft, and a second ball joint positioned between the terminal end portion of the second handle and the shaft. In an example embodiment the first ball joint comprises a first housing mounted on the shaft. A first bushing is mounted within the first housing. A first cap is attached to the first housing overlying the first bushing. A first ball is mounted on the terminal end portion of the grip portion of the first handle. The first ball is seated between the first bushing and the first cap and rotatable relatively to the first housing. The terminal end portion of the grip portion of the first handle extends through an opening defined in the first cap. The opening in the first cap may comprise a slot.

Further by way of example, the second ball joint comprises a second housing mounted on the shaft. A second bushing is mounted within the second housing. A second cap is attached to the second housing overlying the second bushing. A second ball is mounted on the terminal end portion of the grip portion of the second handle. The second ball is seated between the second bushing and the second cap and rotatable relatively to the second housing. The terminal end portion of the grip portion of the second handle extends through an opening defined in the second cap. By way of example the opening in the second cap comprises a slot. In a further example each ball joint comprises a bore defined within the shaft. A ball is received within the bore and is rotatable relatively to the shaft. A slot is positioned within the shaft providing access to the bore. The terminal end portion of each grip portion extends through a respective one of the slots and is attached to a respective one of the balls. By way of example the first and second handles each comprise a respective grip portion having a terminal end portion extending therefrom. The paddle may further comprise a first hinge positioned between the terminal end portion of the first handle and the shaft. A second hinge may be attached to the terminal end portion of the second handle and the shaft. In an example embodiment the grip portion of the first handle is attached to the terminal end portion of the first handle for rotation about a longitudinal axis of the first handle, and the grip portion of the second handle is also attached to the terminal end portion of the second handle for rotation about a longitudinal axis of the second handle.

In an example paddle embodiment according to the invention the first and second blades are attached directly to the first and second ends of the shaft, respectively. Further by way of example the first blade comprises a first crank attached to the first end of the shaft. The first crank is angularly oriented with respect to the longitudinal axis of the shaft and the first blade axis. The second blade comprises a second crank attached to the second end of the shaft. The second crank is angularly oriented with respect to the longitudinal axis of the shaft and the second blade axis. In an example embodiment the first and second cranks are oriented at an angle of 30° with respect to the longitudinal axis of the shaft. In further example embodiments the first and second cranks may be oriented at an angle from 15° to 60° with respect to the longitudinal axis of the shaft. Further by way of example the first and second blade axes are parallel to the longitudinal axis of the shaft. In a particular embodiment a first cushion is attached to the shaft adjacent to the first handle and a second cushion attached to the shaft adjacent to the second handle.

The invention further encompasses a handle mountable on a paddle for watercraft propulsion. In an example embodiment the handle comprises a housing mountable on a shaft of the paddle. A bushing is mounted within the housing. A cap attached to the housing overlies the bushing. A grip portion having a terminal end portion extends therefrom. A ball is mounted on the terminal end portion of the grip portion. The ball is seated between the bushing and the cap and rotatable relatively to the housing. The terminal end portion of the grip portion extends through an opening defined in the cap. In an example embodiment the opening comprises a slot. By way of example the housing may further comprise first and second flanges extending from opposite sides of the housing. Additionally, first and second clamps may be respectively engageable with the first and second flanges for clamping the housing to the paddle.

The invention further encompasses a handle mountable on a paddle for watercraft propulsion. In this example embodiment the handle comprises a grip portion having a terminal end portion extending therefrom. A ball is mounted on the terminal end portion of the grip portion. By way of example the handle comprises a grip portion having a terminal end portion extending therefrom. A hinge is attached to the terminal end portion. The hinge is attachable to the paddle.

The grip portion of the handle is attached to the terminal end portion of the handle for rotation about a longitudinal axis of the handle.

DETAILED DESCRIPTION

Figure 1:
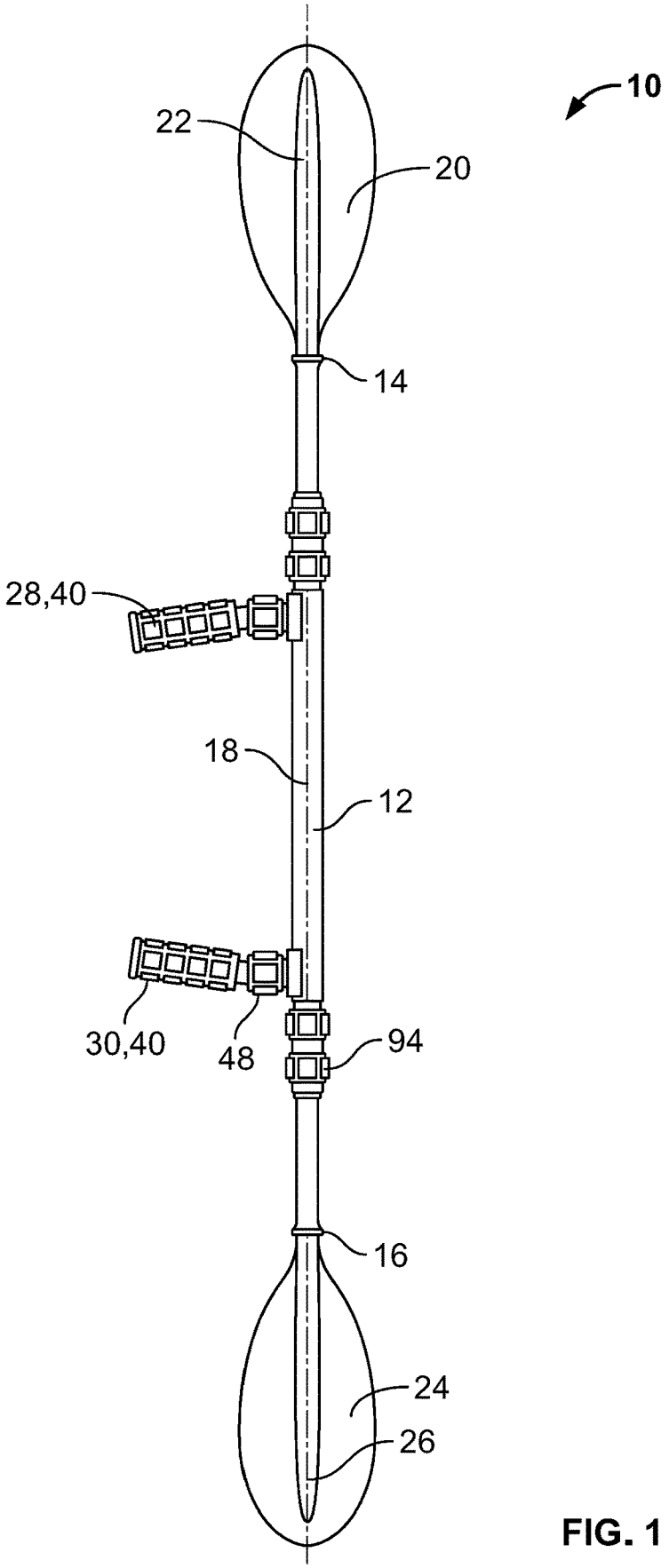
FIG. 1 is a plan view of an example paddle according to the invention.

FIG. 1 shows an example embodiment of a paddle 10 for watercraft propulsion according to the invention. Paddle 10 comprises a shaft 12 having first and second ends 14 and 16 oppositely disposed from one another. A longitudinal axis 18 extends between the first and second end 14 and 16. A first blade 20 is mounted on the first end 14 of the shaft 12. The first blade 20 defines a first blade axis 22 extending lengthwise along the first blade. A second blade 24 is mounted on the second end 16 of the shaft 12. The second blade 24 defines a second blade axis 26 extending lengthwise along the second blade. A first handle 28 is mounted on the shaft 12 between the shaft's first and second ends 14 and 16. The first handle 28 projects transversely to the longitudinal axis 18 of the shaft 12. A second handle 30 is mounted on the shaft 12 between the first handle 28 and the second end 16 of the shaft 12. The second handle 30 also projects transversely to the longitudinal axis 28 of the shaft 12. First and second handles 28 and 30 are in spaced relation to one another for ergonomic advantage to the user.

Figure 2:
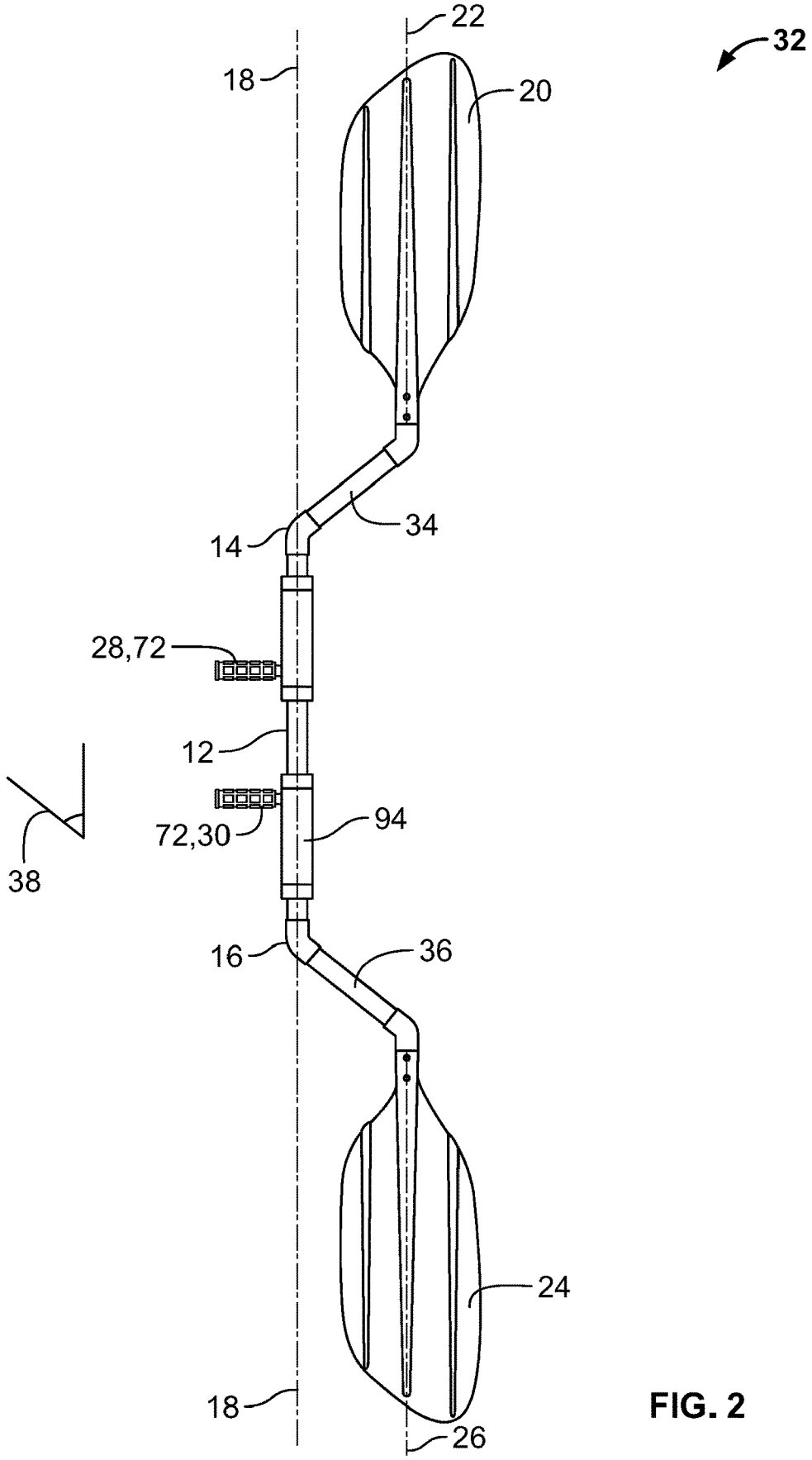
FIG. 2 is a plan view of another example paddle according to the invention.

In the example embodiment 10 the first and second blades 20 and 24 are respectively attached directly to the first and second ends 14 and 16 of shaft 12. Blades 20 and 24 may be oriented at opposite pitch angles about their respective blade axes 22 and 26 as is understood for double bladed paddles. FIG. 2 illustrates another example paddle embodiment 32 according to the invention in which the first blade 20 comprises a first crank 34 attached to the first end 14 of the shaft 12. The first crank 34 is angularly oriented with respect to the longitudinal axis 18 of the shaft 12 and the first blade axis 22 as well. Similarly, the second blade 24 comprises a second crank 36 attached to the second end 16 of the shaft 12. The second crank 36 is also angularly oriented with respect to the longitudinal axis 18 of the shaft 12 and the second blade axis 26. In the example paddle embodiment 32, the first and second cranks 34 and 36 are oriented at an angle 38 of 30° with respect to the longitudinal axis 19 of the shaft 12. However, orientation angles 38 from 15° to 60° with respect to the longitudinal axis 18 of the shaft 12 are also feasible. The first and second blade axes 22 and 26 may be parallel to the longitudinal axis 18 of the shaft 12. As in embodiment 10, the first and second blades 20 and 24 may be oriented at opposite pitch angles about their respective blade axes 22 and 26 in paddle embodiment 32. It is furthermore convenient to allow shaft 12 to be adjustable in length to allow a user to custom fit the paddle to a particular need. This may be accomplished using telescoping sections with spring and plunger detents engaging openings in the sections. The paddle embodiments may also comprise multipart construction, the blades (or blades and cranks) being detachable from the shaft for ease of shipping and transport.

Figure 3:
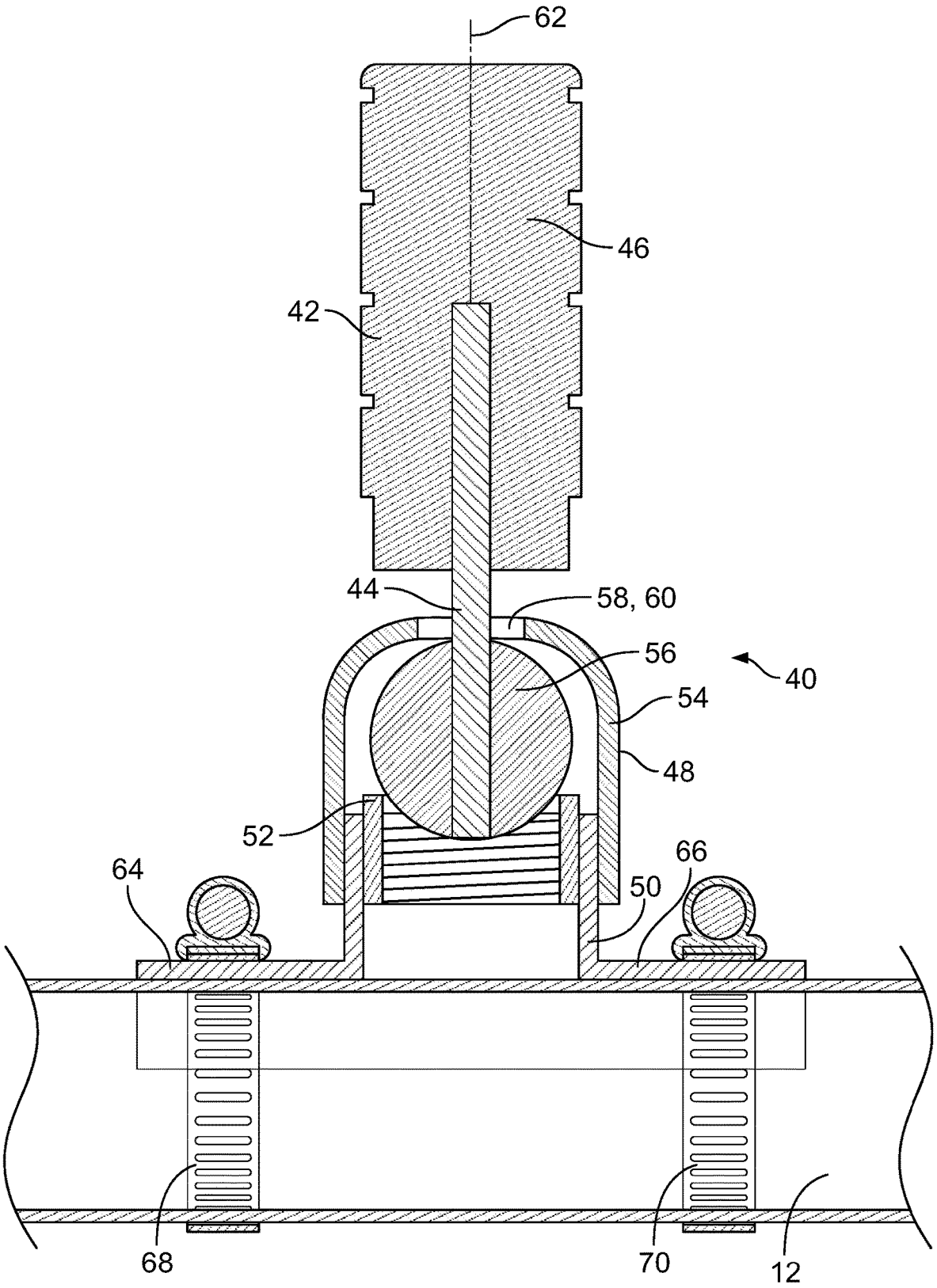
FIG. 3 is a sectional view of a component of an example paddle according to the invention.

In both example paddle embodiments 10 and 32 according to the invention, the first and second handles 28 and 30 are rotatably attached to the shaft 12 for rotational motion relative to the shaft's longitudinal axis 18. FIGS. 1 and 3 illustrate an example handle 40 rotatably attachable to shaft 12. As shown in detail in FIG. 3, handle 40 comprises a grip portion 42 having a terminal end portion 44 extending therefrom. Grip portion 42 may be ergonomically shaped to accommodate the human hand and have raised features 46 to increase purchase. It is advantageous to form the grip portion at least partially from relatively soft, cushioning elastomeric materials, for example, rubber compounds. Terminal end portion 44 is advantageously formed from a rigid rod, stainless steel being preferred for its resistance to corrosion.

A ball joint 48 is positioned between the terminal end portion 44 of the handle 40 and the shaft 12. The use of a ball joint to attach handle 40 to shaft 12 is advantageous because it permits rotation of the handle relative to the shaft about any axis passing through the ball joint's center of rotation. In this example, ball joint 40 comprises a housing 50 mounted on the shaft 12. A bushing 52 is mounted within the housing 50. A cap 54 is attached to the housing 50 overlying the bushing 52. A ball 56 is mounted on the terminal end portion 44 of the grip portion 42 of the handle 40. Attachment of ball 56 to end portion 44 may be effected through peening. Ball 56 is seated between the bushing 52 and the cap 54 and is rotatable relatively to the housing 50. The terminal end portion 44 of the grip portion 42 of the handle 40 extends through an opening 58 defined in the cap 54. In this example the opening 58 comprises a slot 60. Slot 60 is oriented substantially parallel to the longitudinal axis 18 of the shaft 12. Slot 60 constrains the pivoting motion of the handle 40 relatively to the shaft 12, but permits unrestricted rotation of the handle 40 about its longitudinal axis 62. Pivot angles of about 60° are considered advantageous. Example handle embodiment 40 and its ball joint 48 may be integrally formed with the shaft 12 or it may be mounted thereon as a separate component, for example, to retrofit an existing paddle. In one such embodiment, handle 40 may also comprise first and second flanges 64 and 66 extending from opposite sides of the housing 50. First and second clamps 68 and 70 may also be provided to respectively engage with the shaft 12 and the first and second flanges 64 and 66 for clamping the housing 50 to the paddle. Housing 50 may also be attached using fasteners, fittings or adhesive. Attachment via clamps or fittings have the advantage of being positionally adjustable along the length of shaft 12, enabling the user to set the separation distance between the handles which is most comfortable. Handles 40 may be provided with a paddle or separately as a kit for retrofitting existing paddles.

Figure 4:
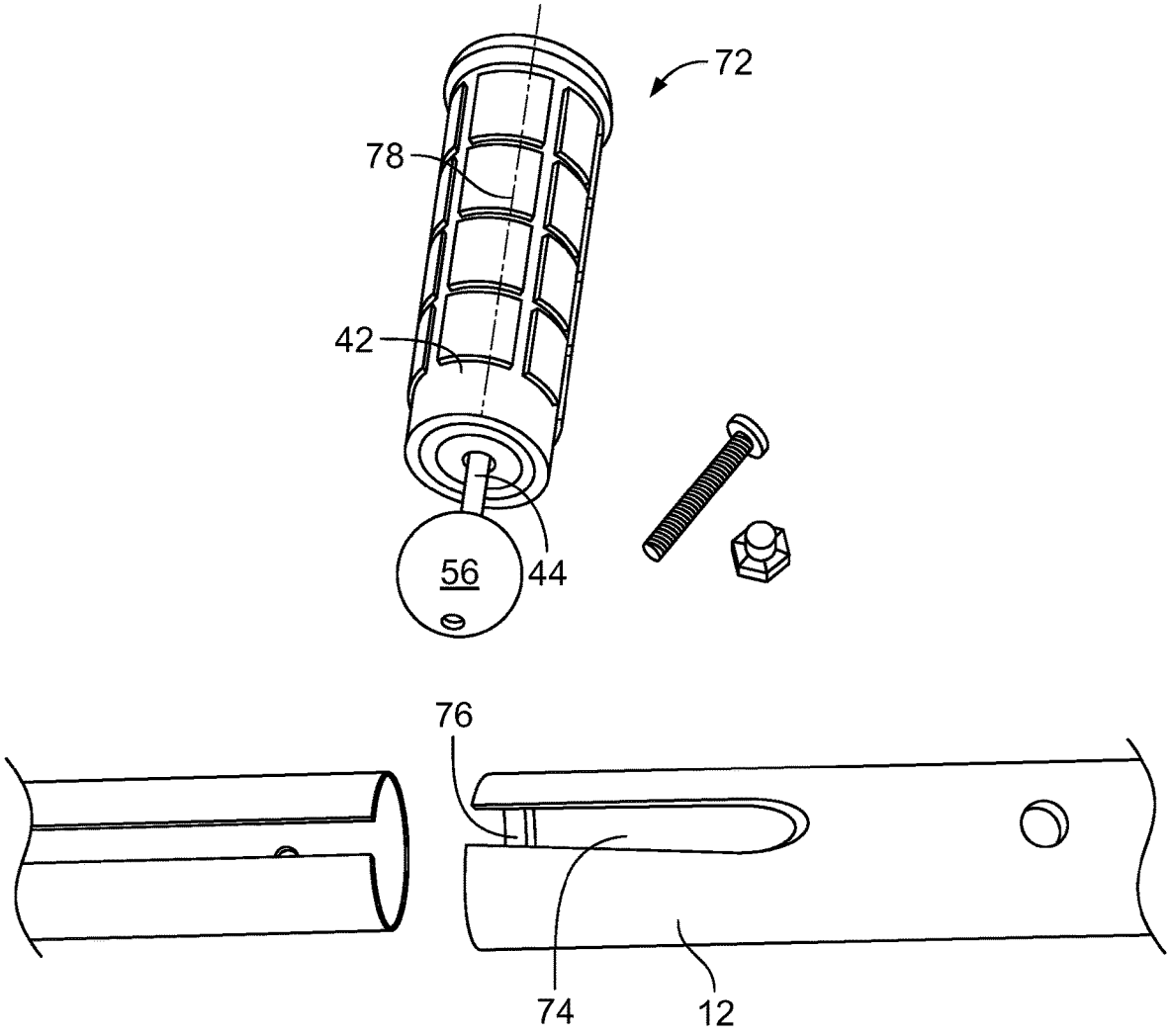
FIG. 4 is an exploded isometric view of a component of an example paddle according to the invention.

FIGS. 2 and 4 show another handle embodiment 72 comprising a grip portion 42 from which extends a terminal end portion 44. A ball 56 is mounted on the terminal end portion 44. Attachment of ball 56 to end portion 44 may be effected through peening. As shown in FIG. 4, ball 56 is received within a bore 74 defined within the shaft 12, the ball being rotatable within bore 74 relatively to the shaft. Shaft 12 is provided in two pieces which slidingly interfit within one another. A fastener may be used to fix the shaft portions to one another via aligning holes. A slot 76 is positioned within the portions of shaft 12 providing access to the bore 74. The terminal end portion 44 of each the grip portion 42 extends through the slot 76. Slot 76 constrains the pivoting motion of handle 72 but permits full rotational motion about the longitudinal axis 78 of handle 72.

Figure 5:
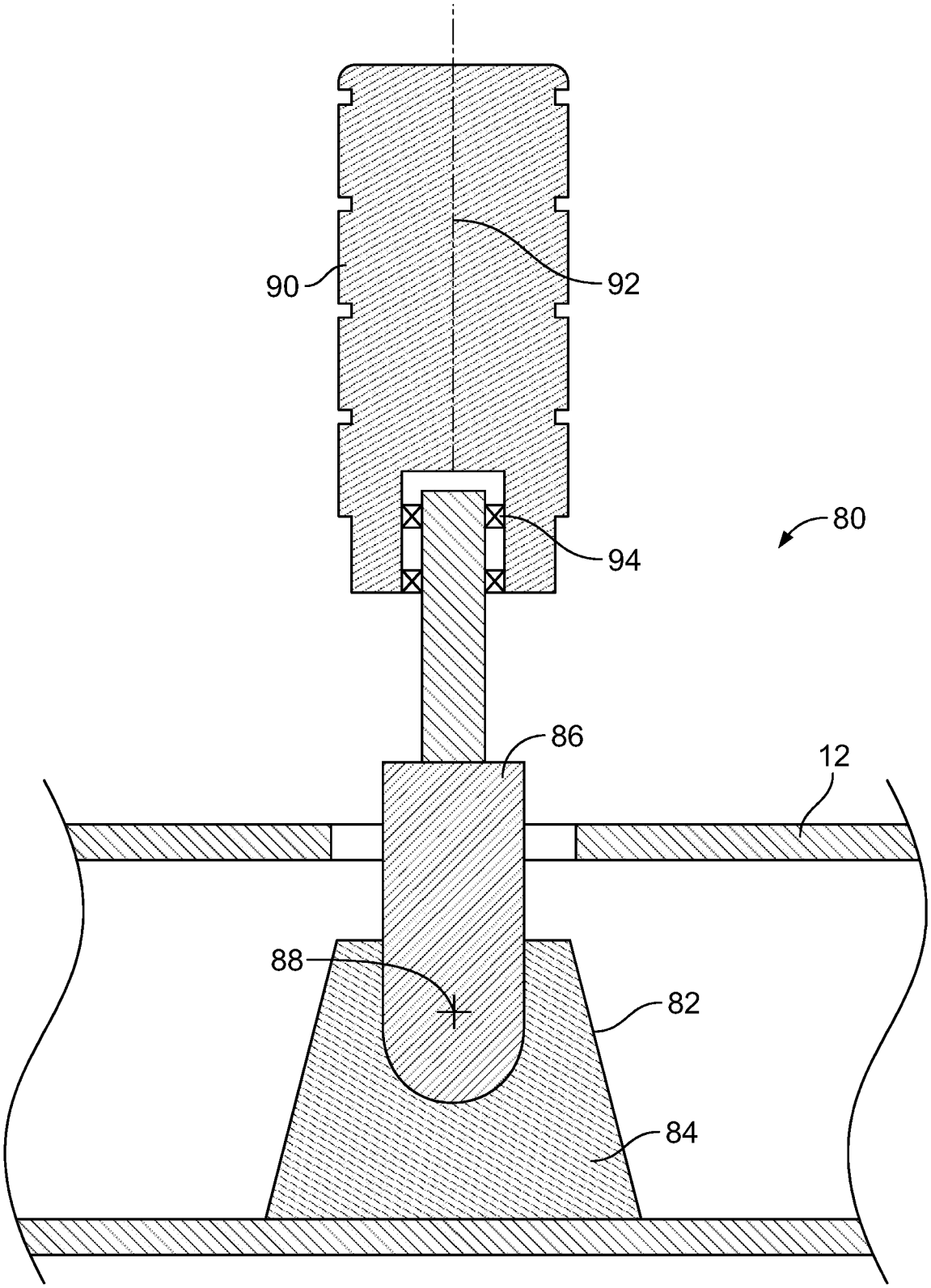
FIG. 5 is a sectional view of a component of an example paddle according to the invention.

FIG. 5 shows another handle embodiment 80 which can be integrally mounted within shaft 12 (shown) or externally mounted as a retrofit to an existing paddle. Handle 80 comprises a hinge 82 having a base 84 attachable to the shaft 12. Handle 80 has a terminal end portion 86 attached to the base for rotation about a pivot axis 88. The terminal end portion 86 of handle 80 is attached to a grip portion 90 of the handle 80. Grip portion 90 is rotatable about the longitudinal axis 92 of handle 80 and bearings 94 positioned between the grip portion 90 and terminal end portion 86 may be used to ensure relative rotation between the grip portion and the terminal end portion 86.

Figure 6:
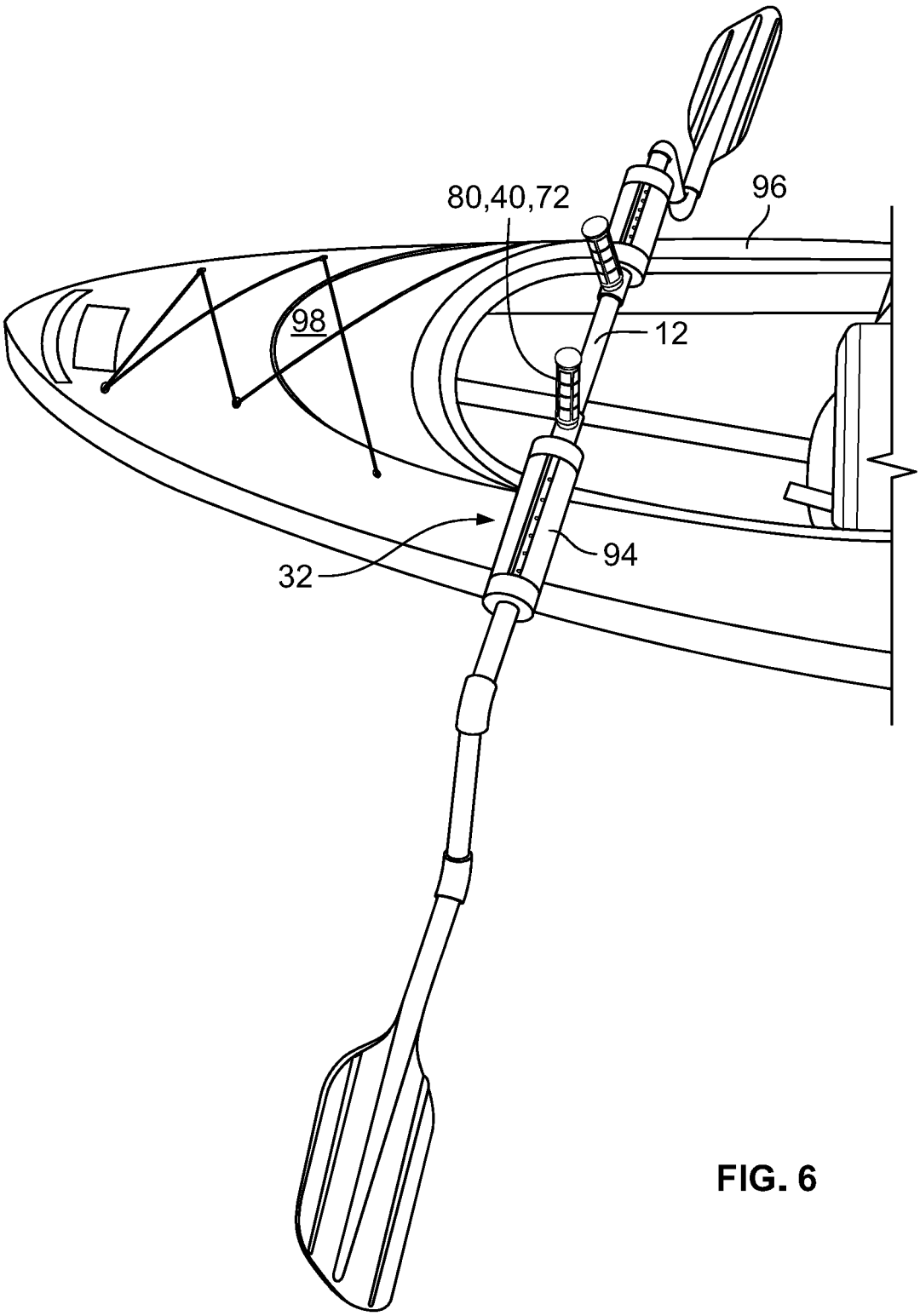
FIG. 6 is an isometric view of an example paddle according to the invention used with a kayak.

For both paddle embodiments 10 and 32 it is considered advantageous to wrap portions of shaft 12 adjacent to the handles 28 and 30 with protective cushions 94. As shown in FIG. 6, cushions 94 allow the shaft 12 to safely contact the watercraft, for example, the cockpit coming 96 of a kayak 98, during the stroke for increased efficiency as described below.

Although certain specific combinations of features are shown in this specification, the combinations are by way of example only, and it is understood that any handle embodiment 40, 72 or 80 could be used with either paddle embodiment 10 or 32.

It is expected that paddles according to the invention will provide more efficient and ergonomically comfortable propulsion for watercraft. Among the features which contribute to this result are the crank mounted blades that place the blades in close proximity to the water surface. The use of handles oriented transversely to the paddle shaft suspends the shaft from the handles, thereby allowing for a low arc paddling motion, eliminating the high arc and water shed of straight shaft paddles, thus adding to paddling efficiency. Pivotably attaching the handles to the paddle shaft allows for an oscillating capability, wherein the paddle shaft may move up and down while the handles remain in a vertical position relative to the water surface. Allowing the handles to rotate about their longitudinal axes permits the paddler to use the power stroke in a back and forth motion, again increasing stroke efficiency. Due to the low arc stroke afforded by the crank blade attachment, the shaft may contact the kayak during a power stroke. Adding cushions to the paddle shaft allows the shaft to glide along the cockpit coming of the kayak which acts as a moving fulcrum, resulting in a smooth, quiet and efficient stroke.

What is claimed is:

1. A paddle for watercraft propulsion, said paddle comprising:

a shaft having first and second ends oppositely disposed and a longitudinal axis extending therebetween;

a first blade mounted on said first end of said shaft, said first blade defining a first blade axis extending lengthwise along said first blade;

a second blade mounted on said second end of said shaft, said second blade defining a second blade axis extending lengthwise along said second blade;

a first handle mounted on said shaft between said first and second ends thereof, said first handle projecting transversely to said longitudinal axis of said shaft;

a second handle mounted on said shaft between said first handle and said second end of said shaft, said second handle projecting transversely to said longitudinal axis of said shaft, said first and second handles being rotatably attached to said shaft for rotational motion relative to said longitudinal axis of said shaft; and wherein said first and second handles each comprise a respective grip portion having a terminal end portion extending therefrom, said paddle further comprising a first ball joint positioned between said terminal end portion of said first handle and said shaft, and a second ball joint positioned between said terminal end portion of said second handle and said shaft.

2. A paddle for watercraft propulsion, said paddle comprising:

a shaft having first and second ends oppositely disposed and a longitudinal axis extending therebetween;

a first blade mounted on said first end of said shaft, said first blade defining a first blade axis extending lengthwise along said first blade;

a second blade mounted on said second end of said shaft, said second blade defining a second blade axis extending lengthwise along said second blade;

a first handle mounted on said shaft between said first and second ends thereof, said first handle projecting transversely to said longitudinal axis of said shaft;

a second handle mounted on said shaft between said first handle and said second end of said shaft, said second handle projecting transversely to said longitudinal axis of said shaft; wherein said first and second handles are rotatably attached to said shaft for rotational motion relative to said longitudinal axis of said shaft, said first and second handles each comprising a respective grip portion having a terminal end portion extending therefrom, said paddle further comprising a first hinge positioned between said terminal end portion of said first handle and said shaft, and a second hinge attached to said terminal end portion of said second handle and said shaft.

3. The paddle according to claim 1, wherein said first ball joint comprises:

a first housing mounted on said shaft;

a first bushing mounted within said first housing;

a first cap attached to said first housing overlying said first bushing;

a first ball mounted on said terminal end portion of said grip portion of said first handle, said first ball being seated between said first bushing and said first cap and rotatable relatively to said first housing, said terminal end portion of said grip portion of said first handle extending through an opening defined in said first cap.

4. The paddle according to claim 3, wherein said opening in said first cap comprises a slot.

5. The paddle according to claim 3, wherein said second ball joint comprises:

a second housing mounted on said shaft;

a second bushing mounted within said second housing;

a second cap attached to said second housing overlying said second bushing;

a second ball mounted on said terminal end portion of said grip portion of said second handle, said second ball being seated between said second bushing and said second cap and rotatable relatively to said second housing, said terminal end portion of said grip portion of said second handle extending through an opening defined in said second cap.

6. The paddle according to claim 5, wherein said opening in said second cap comprises a slot.

7. The paddle according to claim 1, wherein each said ball joint comprises:

a bore defined within said shaft;

a ball received within said bore and rotatable relatively to said shaft;

a slot positioned within said shaft providing access to said bore;

said terminal end portion of each said grip portion extending through a respective one of said slots and attached to a respective one of said balls.

8. The paddle according to claim 2, wherein said grip portion of said first handle is attached to said terminal end portion of said first handle for rotation about a longitudinal axis of said first handle, and said grip portion of said second handle is attached to said terminal end portion of said second handle for rotation about a longitudinal axis of said second handle.

9. The paddle according to claim 1, wherein said first and second blades are attached directly to said first and second ends of said shaft, respectively.

10. The paddle according to claim 1, wherein:

said first blade comprises a first crank attached to said first end of said shaft, said first crank being angularly oriented with respect to said longitudinal axis of said shaft and said first blade axis;

said second blade comprises a second crank attached to said second end of said shaft, said second crank being angularly oriented with respect to said longitudinal axis of said shaft and said second blade axis.

11. The paddle according to claim 10, wherein said first and second cranks are oriented at an angle of 30° with respect to said longitudinal axis of said shaft.

12. The paddle according to claim 10, wherein said first and second cranks are oriented at an angle from 15° to 60° with respect to said longitudinal axis of said shaft.

13. The paddle according to claim 10, wherein said first and second blade axes are parallel to said longitudinal axis of said shaft.

14. The paddle according to claim 1, further comprising a first cushion attached to said shaft adjacent to said first handle and a second cushion attached to said shaft adjacent to said second handle.

15. A handle mountable on a paddle for watercraft propulsion, said handle comprising:

a housing mountable on a shaft of said paddle;

a bushing mounted within said housing;

a cap attached to said housing overlying said bushing;

a grip portion having a terminal end portion extending therefrom;

a ball mounted on said terminal end portion of said grip portion;

wherein said ball is seated between said bushing and said cap and rotatable relatively to said housing, said terminal end portion of said grip portion extending through an opening defined in said cap.

16. The handle according to claim 15, wherein said opening comprises a slot.

17. The handle according to claim 15, wherein said housing comprises first and second flanges extending from opposite sides of said housing.

18. The handle according to claim 17, further comprising first and second clamps respectively engageable with said first and second flanges for clamping said housing to said paddle.

19. The paddle according to claim 2, wherein said first and second blades are attached directly to said first and second ends of said shaft, respectively.

20. The paddle according to claim 2, wherein:

said first blade comprises a first crank attached to said first end of said shaft, said first crank being angularly oriented with respect to said longitudinal axis of said shaft and said first blade axis;

said second blade comprises a second crank attached to said second end of said shaft, said second crank being angularly oriented with respect to said longitudinal axis of said shaft and said second blade axis.

21. The paddle according to claim 20, wherein said first and second cranks are oriented at an angle of 30° with respect to said longitudinal axis of said shaft.

22. The paddle according to claim 20, wherein said first and second cranks are oriented at an angle from 15° to 60° with respect to said longitudinal axis of said shaft.

23. The paddle according to claim 20, wherein said first and second blade axes are parallel to said longitudinal axis of said shaft.

24. The paddle according to claim 2, further comprising a first cushion attached to said shaft adjacent to said first handle and a second cushion attached to said shaft adjacent to said second handle.

25. A paddle for watercraft propulsion, said paddle comprising:

a shaft having first and second ends oppositely disposed and a longitudinal axis extending therebetween;

a first blade mounted on said first end of said shaft, said first blade defining a first blade axis extending lengthwise along said first blade;

a second blade mounted on said second end of said shaft, said second blade defining a second blade axis extending lengthwise along said second blade;

a first handle mounted on said shaft between said first and second ends thereof, said first handle projecting transversely to said longitudinal axis of said shaft;

a second handle mounted on said shaft between said first handle and said second end of said shaft, said second handle projecting transversely to said longitudinal axis of said shaft; wherein said first blade comprises a first crank attached to said first end of said shaft, said first crank being angularly oriented with respect to said longitudinal axis of said shaft and said first blade axis; and said second blade comprises a second crank attached to said second end of said shaft, said second crank being angularly oriented with respect to said longitudinal axis of said shaft and said second blade axis.

26. The paddle according to claim 25, wherein said first and second cranks are oriented at an angle of 30° with respect to said longitudinal axis of said shaft.

27. The paddle according to claim 25, wherein said first and second cranks are oriented at an angle from 15° to 60° with respect to said longitudinal axis of said shaft.

28. The paddle according to claim 25, wherein said first and second blade axes are parallel to said longitudinal axis of said shaft.

29. The paddle according to claim 25, further comprising a first cushion attached to said shaft adjacent to said first handle and a second cushion attached to said shaft adjacent to said second handle.

30. A paddle for watercraft propulsion, said paddle comprising:

a shaft having first and second ends oppositely disposed and a longitudinal axis extending therebetween;

a first blade mounted on said first end of said shaft, said first blade defining a first blade axis extending lengthwise along said first blade;

a second blade mounted on said second end of said shaft, said second blade defining a second blade axis extending lengthwise along said second blade;

a first handle mounted on said shaft between said first and second ends thereof, said first handle projecting transversely to said longitudinal axis of said shaft;

a second handle mounted on said shaft between said first handle and said second end of said shaft, said second handle projecting transversely to said longitudinal axis of said shaft; wherein a first cushion is attached to said shaft adjacent to said first handle and a second cushion is attached to said shaft adjacent to said second handle.

* * * * *